US006091366A

United States Patent [19]

Zhang et al.

[11] Patent Number: 6,091,366

[45] Date of Patent: Jul. 18, 2000

[54] MICROSTRIP TYPE ANTENNA DEVICE

[75] Inventors: Xin Zhang; Kazuhisa Uehara, both of Ibaraki, Japan

[73] Assignee: Hitachi Cable Ltd., Tokyo, Japan

[21] Appl. No.: 09/112,157

[22] Filed: Jul. 9, 1998

[30] Foreign Application Priority Data

Jul. 14, 1997 [JP] Japan ..... 9-188453
Aug. 6, 1997 [JP] Japan ..... 9-212048

[51] Int. Cl.[7] ..... H01Q 1/38
[52] U.S. Cl. ..... 343/700 MS
[58] Field of Search ..... 343/700 MS, 795, 343/803, 853, 815, 817, 731, 830, 846, 848

[56] References Cited

U.S. PATENT DOCUMENTS

| | | | |
|---|---|---|---|
| 4,074,270 | 2/1978 | Kaloi | 343/853 |
| 4,899,164 | 2/1990 | McGrath | 343/700 MS |
| 5,420,596 | 5/1995 | Burrell et al. | 343/700 MS |
| 5,635,942 | 6/1997 | Kushihi et al. | 343/700 MS |
| 5,661,494 | 8/1997 | Bondyopadhyay | 343/700 MS |
| 5,838,285 | 11/1998 | Tay et al. | 343/853 |
| 5,903,239 | 5/1999 | Takahashi et al. | 343/700 MS |

FOREIGN PATENT DOCUMENTS 59-97207 6/1984 Japan .

*Primary Examiner*—Tan Ho
*Attorney, Agent, or Firm*—McDermott, Will & Emery

[57] ABSTRACT

A conductive micro-strip line, a feeding line in contact with the micro-strip, and a radiation element connected to the feeding line are provided on a dielectric or semiconductor substrate, and a ground conductor is provided on the side of the substrate opposite to the micro-strip line to establish a diversification antenna and an array antenna. In accordance with another aspect, a plurality of antennas, each comprising a dielectric or semiconductor substrate, a conductive film provided on one side of the substrate for constituting a radiation element and a micro-strip line including a feeding line leading to the radiation element, and a ground conductor film provided on the other side of the substrate, are arranged. A coaxial feeding line leading to one of the antennas is provided along the ground plane, of another antenna, on which the ground conductor film is provided. This construction inhibits the influence of the coaxial feeding line on the radiation and impedance characteristics of another antenna.

46 Claims, 10 Drawing Sheets

MICROSTRIP TYPE ANTENNA DEVICE

FIELD OF THE INVENTION

The invention relates to an antenna, and more particularly to an antenna which is fabricated to be thin by forming a conductive pattern on a substrate.

BACKGROUND OF THE INVENTION

A conventional sleeve antenna comprises a radiation element having an electrical length of one quarter wavelength, a sleeve having an electrical length of one quarter wavelength, and a coaxial cable for feeding an electric power to the radiation element, wherein an outer conductor of the coaxial cable is connected to the sleeve, while an inner conductor of the coaxial cable is extended through the sleeve to be connected to the radiation element.

A conventional inverted type coaxial dipole antenna is structured such that a central conductor of a coaxial cable is connected via a feeding line to a sleeve, wherein the feeding line is extended through a slot which is formed through an outer tube.

A conventional flat antenna comprises a flat substrate, on a first surface of which a micro-strip of a thin conductive film is formed, and on a second surface of which a dipole antenna element and a feeding slot are formed.

In the conventional antennas as simply explained above, however, there are disadvantages as set out below.

The conventional sleeve antenna and inverted type coaxial dipole antenna involve complicated fabrication and adjustment because the feeding coaxial cable is connected to the sleeve. This is causative of instable quality.

On the other hand, the flat antenna can solve the above problems involved in the conventional sleeve antenna and inverted type coaxial dipole antenna. It, however, cannot be diversified because a feeding slot is provided on the ground plane. The diversification refers to combining of a plurality of antennas to enhance the transmitting/receiving capacity.

Japanese Patent Laid-Open No. 59-97207 discloses a diversity antenna which comprises two sleeve antennas vertically arranged to provide diversity effect.

The diversity antenna, however, is disadvantageously heavy and difficult to handle. Further, in the individual sleeve antennas, there are many steps requiring handwork, such as fabrication and adjustment for connecting the feeding coaxial cable to the sleeve, which is causative of instable quality and in addition makes it difficult to reduce the cost.

SUMMARY OF THE INVENTION

Accordingly, it is an object of the invention to provide an antenna which is adapted to be a diversity antenna.

It is another object of the invention to provide a diversity antenna which is lightweight, easy to handle, and highly reliable and can be produced in stable quality at a lower cost.

According to the first feature of the invention, an antenna, comprises: a dielectric or semiconductor substrate; and, provided on the substrate, a conductive micro-strip line, a feeding line in contact with the micro-strip line, and a radiation element connected to the feeding line, a ground conductor being provided on the side of the substrate opposite to the micro-strip line.

According to the second feature of the invention, a diversity antenna, comprises a plurality of arranged antennas, each of the antenna comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along the ground plane, of another antenna, on which the ground conductor film is provided.

BRIEF DESCRIPTION OF THE DRAWINGS

The invention will be explained in more detail in conjunction with appended drawings, wherein.

DESCRIPTION OF THE PREFERRED EMBODIMENTS

Before explaining an antenna in the preferred embodiment according to the invention, the aforementioned conventional antennas will be explained in more detail.

Figure 1:
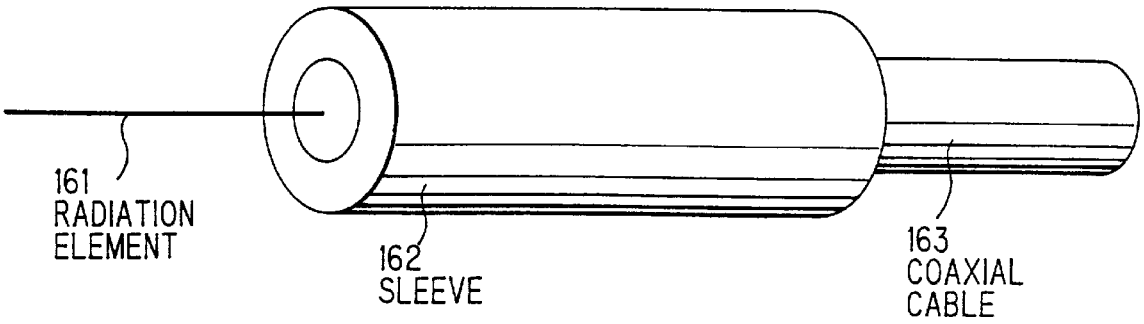
FIG. 1 PRIOR ART
FIG. 1 is a perspective view of a conventional sleeve antenna.

FIG. 1 is a conventional sleeve antenna. Numeral 161 designates a radiation element having an electrical length of one quarter wavelength, numeral 162 a sleeve (a cylindrical tube) having an electrical length of one quarter wavelength, and numeral 163 a feeding coaxial cable. The outer conductor of the coaxial cable 163 is connected to the sleeve 162, while a central conductor of the coaxial cable 163 is connected to the radiation element 161. This sleeve antenna has operating performance equal to a dipole antenna comprising the radiation element 161 and the sleeve 162, good efficiency, good directivity, and stable impedance.

Figure 2:
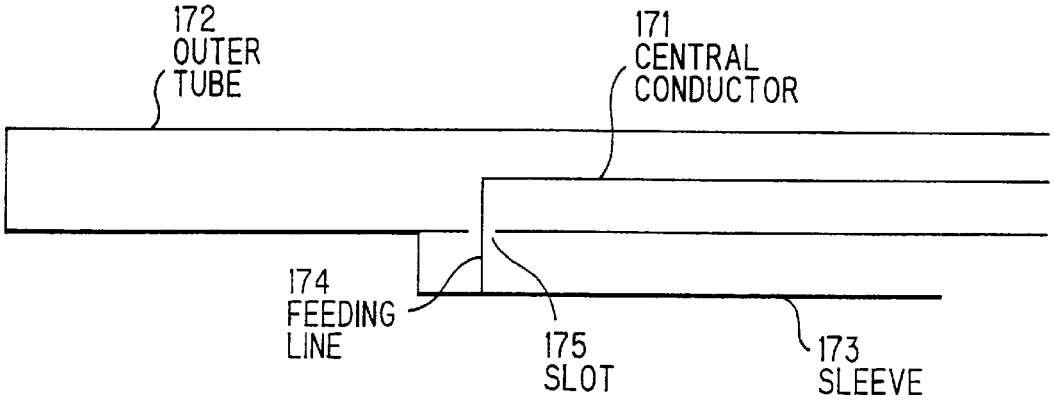
FIG. 2 PRIOR ART
FIG. 2 is a cross-sectional view of a conventional inverted type coaxial dipole antenna.

FIG. 2 shows a cross-sectional view of a conventional inverted type coaxial dipole antenna where a central conductor 171 and an outer tube 172 are replaced with each other. The central conductor 171 is connected to the sleeve 173 via the feeding line 174 passing through the slot 175 of the outer tube 172. This inverted type coaxial dipole antenna has operation performance equivalent to the above sleeve antenna, good efficiency, good directivity, and stable impedance. Further, a plurality of this type of antennas may be arranged to form an array antenna.

Figure 3:
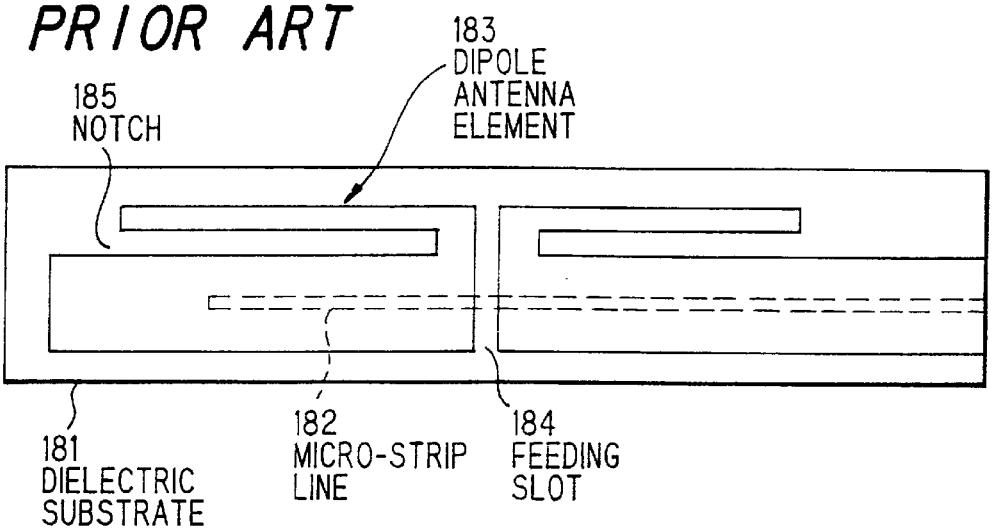
FIG. 3 PRIOR ART
FIG. 3 is a plan view of a conventional flat antenna.

FIG. 3 shows a conventional flat antenna comprising a conductor provided on a substrate. In the drawing, numeral 181 designates a dielectric substrate, numeral 182 a micro-strip line of a thin-film conductor, numeral 183 a dipole antenna element of a conductor provided on the side of the substrate 181 opposite to the micro-strip line (ground plane; this drawing showing grand plane), numeral 184 a feeding slot, and numeral 185 a notch having an electrical length of one quarter wavelength. This antenna has operation performance equivalent to the above sleeve antenna, good efficiency, good directivity, and stable impedance.

Figure 4:
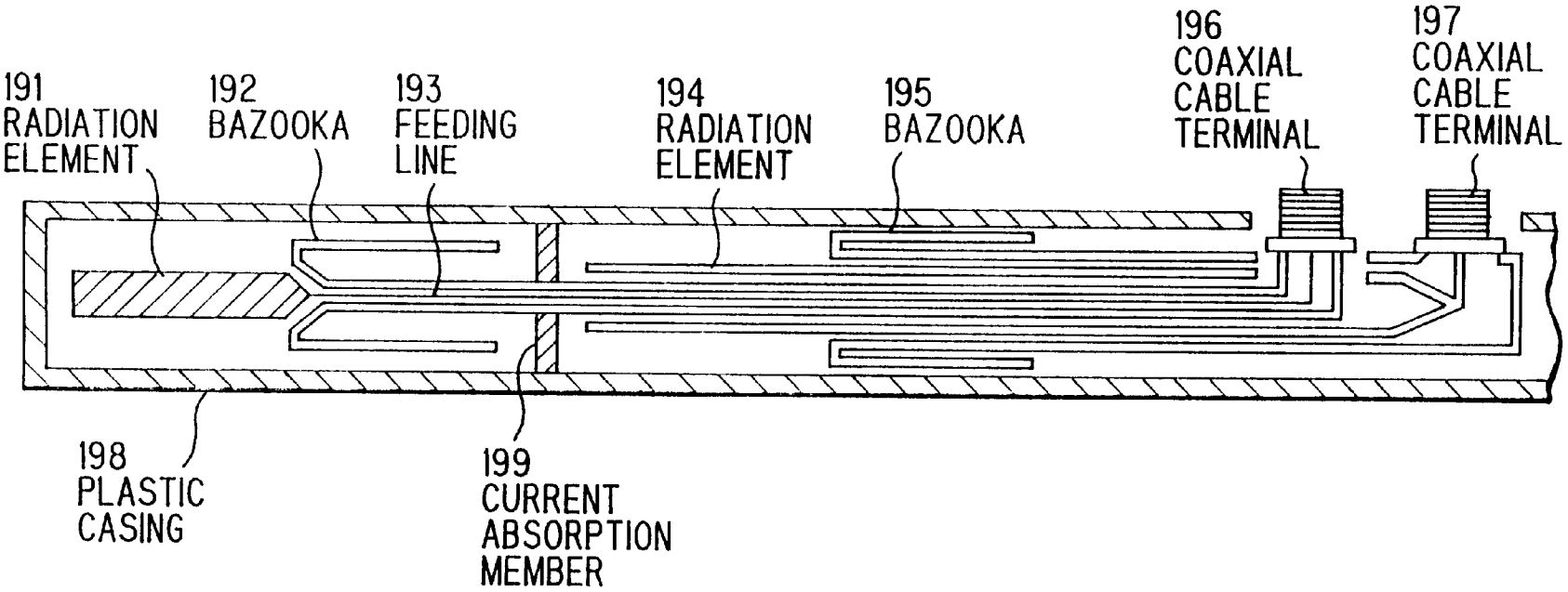
FIG. 4 PRIOR ART
FIG. 4 is a diagram showing the construction of a conventional diversity antenna using a sleeve antenna.

FIG. 4 shows a diversity antenna described in Japanese Patent Laid-Open No. 59-97207. This diversity antenna is structured so that two sleeve antennas (upper and lower antennas) are vertically arranged (the sleeve antenna on the left side in the drawing being the upper sleeve antenna) so as to attain diversity effect. It is applied to a mobile station in land mobile communication using vertically polarized plane wave. The sleeve constituting the antenna is constituted by a conductive pipe, such as a copper pipe. In the drawing, numerals 191 and 194 each designate a radiation element having an electrical length of one quarter wavelength, numerals 192 and 195 each a bazooka having an electrical length of one quarter wavelength, numeral 193 a feeding line extended to the upper sleeve antenna, numerals 196 and 197 each a coaxial cable terminal, numeral 198 a plastic casing, and numeral 199 a current absorption member. The feeding line 193 extended to the upper sleeve antenna is provided through the axial center portion in the interior of the lower sleeve antenna. In this diversity antenna, the feeding line 193 does not influence the radiation characteristics and impedance characteristics of the lower sleeve antenna, and both the upper sleeve antenna and the lower sleeve antenna can realize good radiation characteristics and impedance characteristics.

Next, an antenna in the preferred embodiment according to the invention will be explained.

Figure 5A:
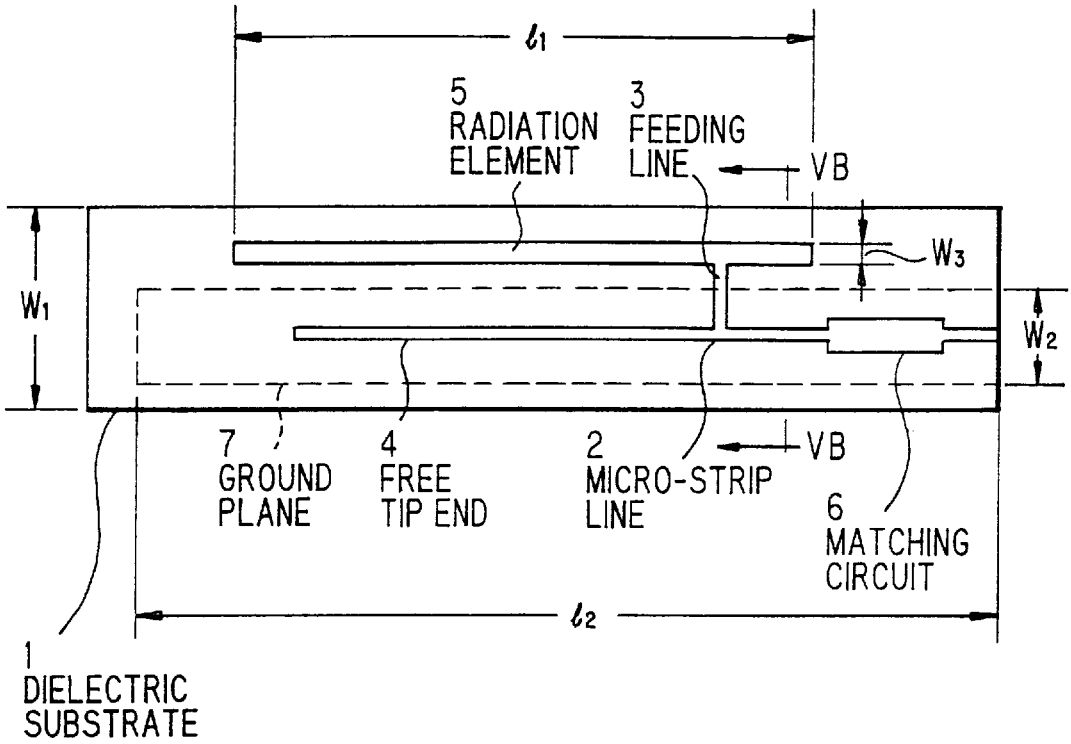
FIG. 5A is a plan view of an antenna according to a preferred embodiment of the invention.
Figure 5B:
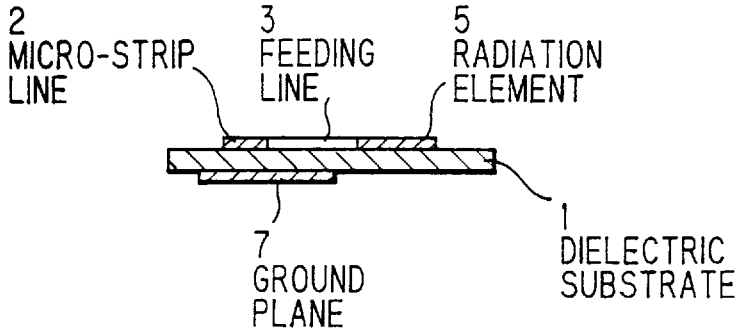
FIG. 5B is a cross-sectional view taken on line VB—VB of FIG. 5A.

In FIGS. 5A and 5B, the substrate 1 of the antenna is made of a dielectric, for example, Teflon (tradename), and is in a rectangular form. On the substrate 1 is provided a micro-strip line 2 having small width, made of a conductor, which extends from substantially the center portion of the short side in the longitudinal direction to a predetermined position. A feeding line 3 having small width, made of a conductor, is provided so as to extend from a certain position between both ends of the micro-strip line 2 to a predetermined position. This feeding line 3 is also called a "feeding micro-strip line." The portion between the front end of the micro-strip line 2 and the site at which the feed line 3 is provided is not connected to anywhere, and this portion is called a free tip end micro-strip line 4. A radiation element 5 made of a conductor is provided at the tip end of the feeding line 3. The radiation element 5 is also called a "antenna radiation element." This radiation element 5 has an electrical length of a half wavelength in the longitudinal direction. A distributed element matching circuit 6 is provided on the base end side of the microstrip line 2. A ground conductor 7 is provided on the opposite side of the substrate 1. The ground conductor 7 is provided, for example, in a rectangular form, so as to face the micro-strip line 2 and has wider line width than the micro-strip line 2. The ground conductor 7 is also referred to as a "ground plane." Each portion of the conductor on the substrate 1 may be prepared by applying a conductive foil, for example, a copper foil. Alternatively, it may be prepared by a microfabrication process and a printed board fabrication process.

In FIG. 5A, when the wavelength $\lambda$ of the transmitting/receiving signal is, for example, 158 mm, for example, $l_1$, $l_2$, $w_1$, $w_2$, and $w_3$ are set as follows:

$l_1=\lambda/2$ (79 mm);

$l_2=\lambda$ (158 mm);

$w_1=0.1\lambda$ (15.8 mm);

$w_2=0.07\lambda$ (11.1 mm); and $w_3=0.01\lambda$ (1.6 mm).

The operation and impedance matching of this antenna will be explained.

A feeding signal applied to the micro-strip line 2 passes through the feeding line 3 and is applied to the radiation element 5. That is, a signal is fed to the radiation element 5. This permits a radio wave to be radiated from the radiation element 5. Impedance matching between the radiation element 5 and the feeding line 3 may be performed by regulating the width of the feeding line 3, by regulating the position, in the longitudinal direction of the radiation element 5, at which the feeding line 3 is connected to the radiation element 5, that is, the position of the feeding site, by regulating the length of the free tip end micro-strip line 4, or by regulating the geometry of the matching circuit 6. Further, these matching methods may be used in combination to provide optimal impedance matching. Further, regulation of the distance between the radiation element 5 and the ground conductor 7 can offer a high gain.

In the antenna shown in FIGS. 5A and 5B, the conductor is provided on the substrate 1, realizing a thin, lightweight antenna. Further, since the antenna may be prepared by the microfabrication process and the printed board fabrication process, the dimensional accuracy is very good. Furthermore, since the substrate and each portion of the conductor are integral with each other, there is no need to conduct assembling and regulation. This offers excellent mass productivity. In addition, the construction of the antenna comprising the micro-strip line, feeding line, and radiation element each made of a conductor can realize a diversity antenna.

Other preferred embodiments of the invention will be explained.

Figure 6:
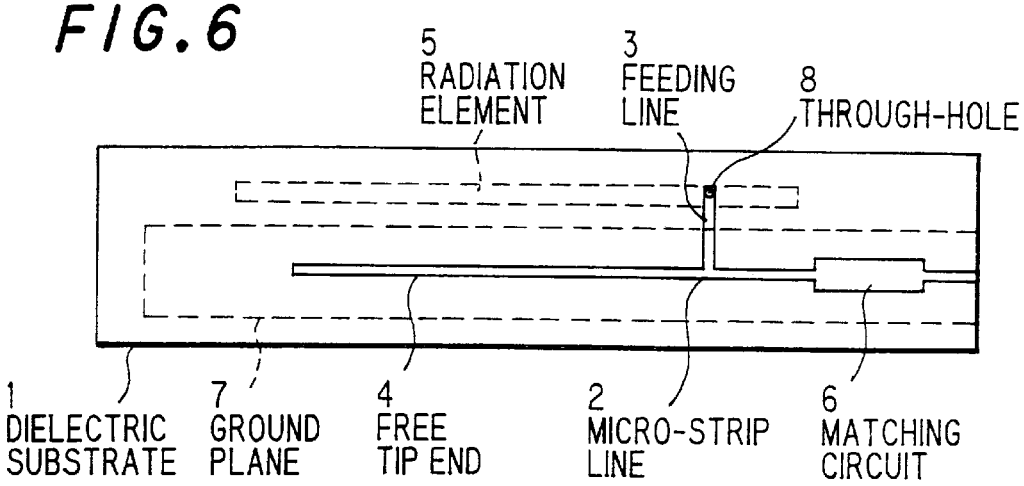
FIG. 6 is a plan view of an antenna according to another preferred embodiment of the invention.

The antenna shown in FIG. 6 has the same construction as that shown in FIGS. 5A and 5B, except that, in the antenna shown in FIGS. 5A and 5B, the micro-strip line 2, the feeding line 3, and the radiation element 5 are arranged in the same plane of the substrate 1, whereas the radiation element 5 is provided on the side of the substrate 1 opposite to the micro-strip line 2. Therefore, in the antenna shown in FIG. 6, the ground conductor 7 and the radiation element 5 are present in the same plane of the substrate 1. The radiation element 5 is connected to the feeding line 3 via a through-hole 8.

The operation and effect of the antenna shown in FIG. 6 are substantially equivalent to the antenna shown in FIGS. 5A and 5B. In the antenna shown in FIG. 6, however, since the ground conductor 7 and the radiation element 5 are provided in the same plane of the substrate 1, the contribution of the feeding line 3 to the antenna radiation pattern can be reduced.

Figure 7:
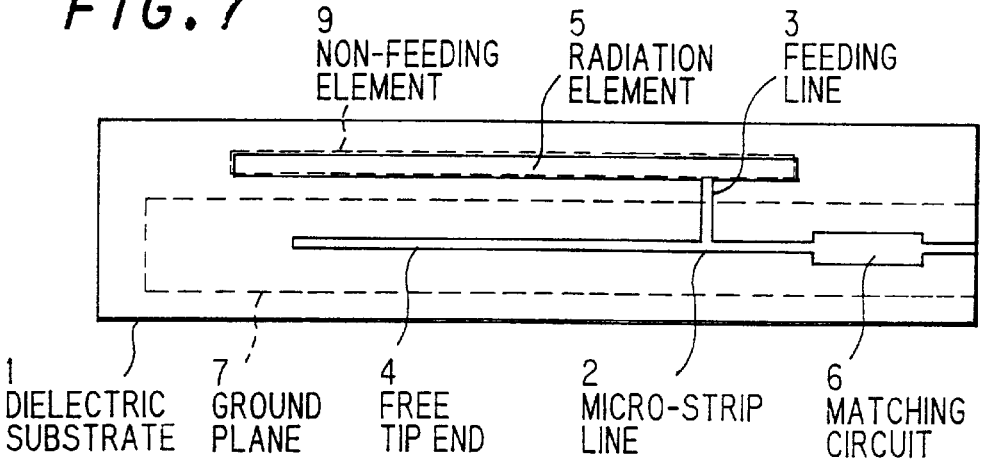
FIG. 7 is a plan view of an antenna according to still another preferred embodiment of the invention.
Figure 8:
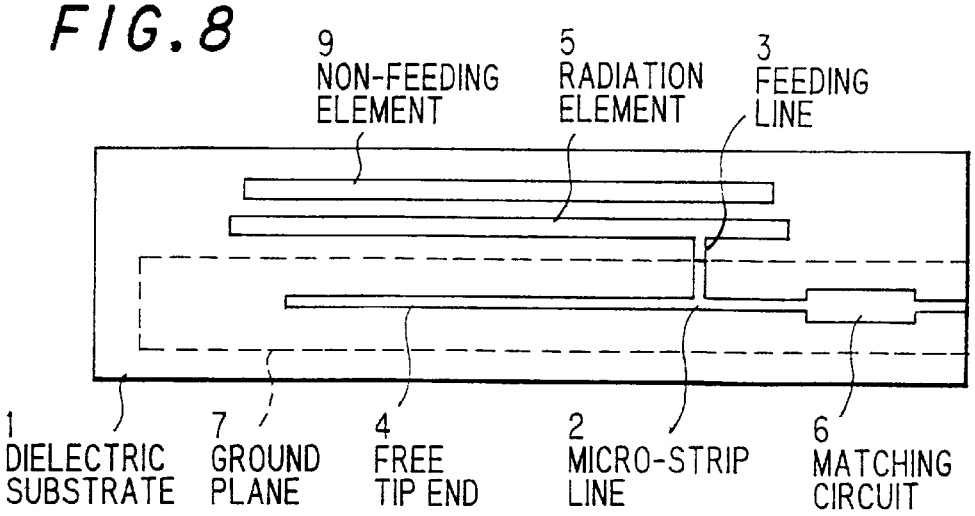
FIG. 8 is a plan view of an antenna according to a further preferred embodiment of the invention.

The antennas shown in FIGS. 7 and 8 have the same construction as FIGS. 5A and 5B, except that a non-feeding element 9 is provided.

Figure 9:
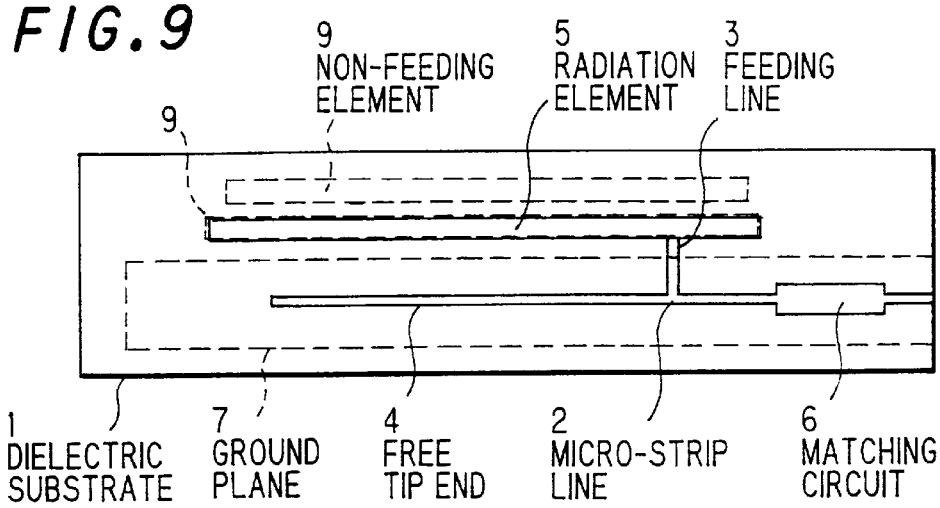
FIG. 9 is a plan view of an antenna according to a still further preferred embodiment of the invention.

The non-feeding element 9 is provided along the radiation element 5. In FIG. 7, the non-feeding element 9 is provided on the side of the substrate 1 opposite to the radiation element 5. That is, the micro-strip line 2, the feeding line 3, and the radiation element 5 are arranged in the same plane of the substrate 1, while the non-feeding element 9 and the ground conductor 7 exist in the same plane of the substrate 1. In the antenna shown in FIG. 8, the non-feeding element 9 is provided in the same plane of the substrate 1 as the radiation element 5. As shown in the drawing, the non-feeding element 9 is provided, on the outside of the radiation element 5 (on the side of the radiation element 5 remote from the micro-strip line 2), in parallel with the radiation element 5. The antenna shown in FIG. 9 has a plurality of non-feeding elements and has the same construction as the antenna shown in FIG. 7, except that an outer non-feeding element 9 is additionally provided in the antenna. The operation and effect of these antennas are substantially equivalent to those of the antenna shown in FIGS. 5A and 5B. In addition, the provision of the non-feeding element 9 along the radiation element 5 can broaden the band.

Figure 10:
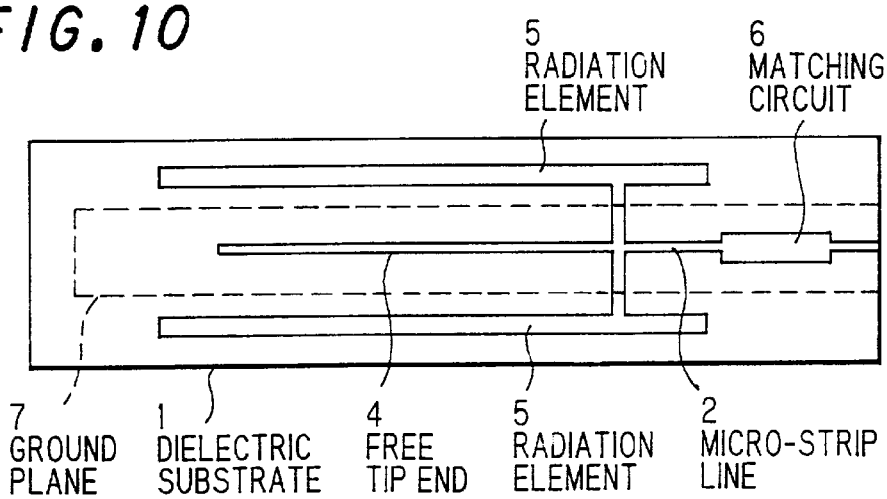
FIG. 10 is a plan view of an antenna according to another preferred embodiment of the invention.
Figure 11:
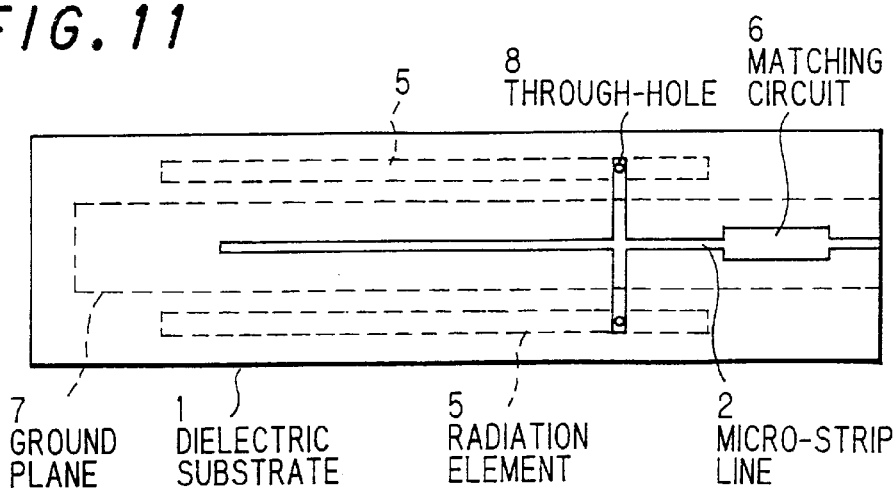
FIG. 11 is a plan view of an antenna according to a further preferred embodiment of the invention.

The antenna shown in FIGS. 10 and 11 has the same construction as the antennas shown in FIGS. 5A, 5B, and 6, except that, in the antennas shown in FIGS. 5A, 5B, and 6, the radiation element 5 is provided on one side of the micro-strip line 2, whereas in the antenna shown in FIGS. 10 and 11, the radiation element 5 is provided on both sides of the micro-strip line 2. The operation and effect of these antennas shown in FIGS. 10 and 11 are substantially equivalent to the antennas shown in FIGS. 5A, 5B, and 6. In addition, the provision of the radiation element 5 on both sides of the micro-strip line 2 can stabilize the directivity, enabling the polarization characteristics to be made close to a nondirectional one.

Figure 12:
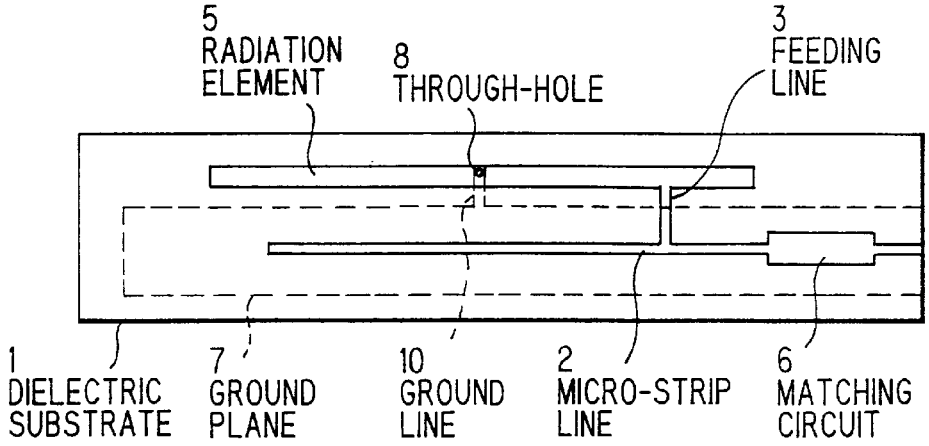
FIG. 12 is a plan view of an antenna according to a still further preferred embodiment of the invention.
Figure 13:
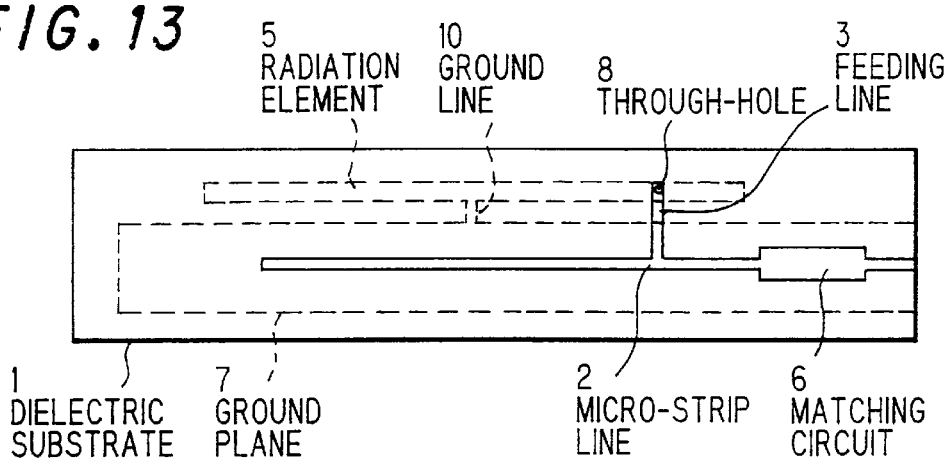
FIG. 13 is a plan view of an antenna according to another preferred embodiment of the invention.
Figure 14:
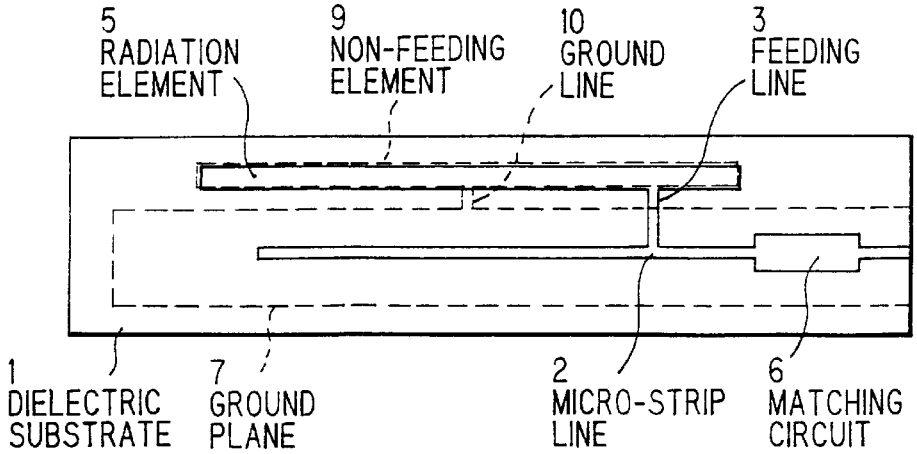
FIG. 14 is a plan view of an antenna according to a further preferred embodiment of the invention.

The antennas shown in FIGS. 12 and 13 have the same construction as the antennas shown in FIGS. 5A, 5B, and 6, except that the radiation element 5 is short-circuited by the ground conductor 7 at one point. In the antenna shown in FIG. 12, since the radiation element 5 is provided on the side of the substrate 1 opposite to the ground conductor 7, a line 10 is lead from the ground conductor 7 and connected to the radiation element 5 via a through-hole 8. The connection site is the middle point in the longitudinal direction of the radiation element 5. In the antenna shown in FIG. 13, the radiation element 5 and the ground conductor 7 are arranged in the same plane of the substrate 1. In this case, the line 10 is lead from the ground conductor 7 and intersects the radiation element 5. The antenna shown in FIG. 14 has the same construction as the antenna shown in FIG. 7, except that the non-feeding element 9 is short-circuited by the ground conductor 7 at one point. In this antenna, the non-feeding element 9 and the ground conductor 7 are arranged in the same plane of the substrate 1, and a line 10 is led from the ground conductor 7 and intersects the non-feeding element 9. The connection site is the middle point in the longitudinal direction of the non-feeding element 9. Alternatively, the antenna may be constructed so that the tip end of the micro-strip line 2 is short-circuited by the ground conductor (not shown).

Figure 15:
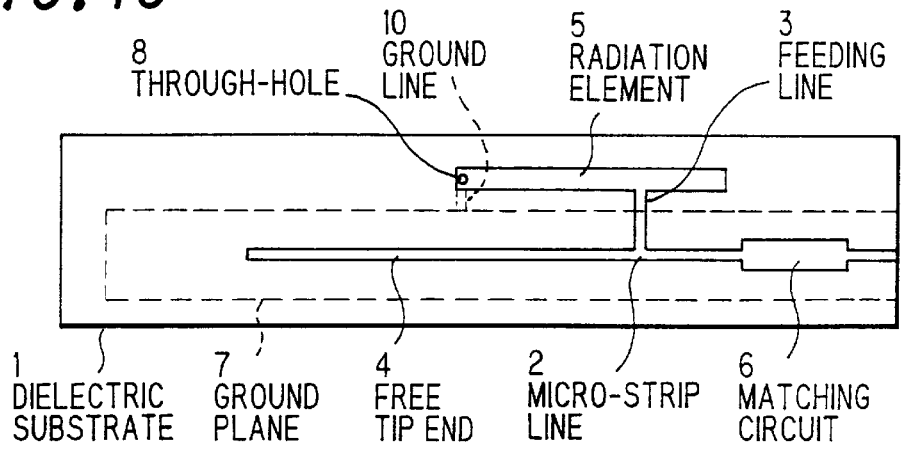
FIG. 15 is a plan view of an antenna according to still further preferred embodiment of the invention.
Figure 16:
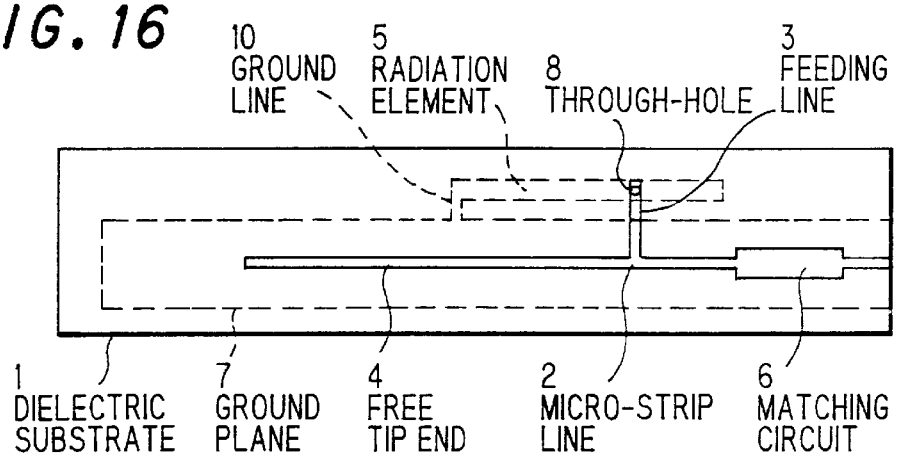
FIG. 16 is a plan view of an antenna according to another preferred embodiment of the invention.

The antennas shown in FIGS. 15 and 16 have the same construction as the antennas shown in FIGS. 12 and 13, except that the radiation element 5 extends to the site of connection to the ground conductor 7 and the portion ahead of the connection site has been removed. The operation and effect of the antennas are substantially equivalent to those of the antennas shown in FIGS. 12 and 13. Therefore, the size of the antenna can be reduced.

Figure 17:
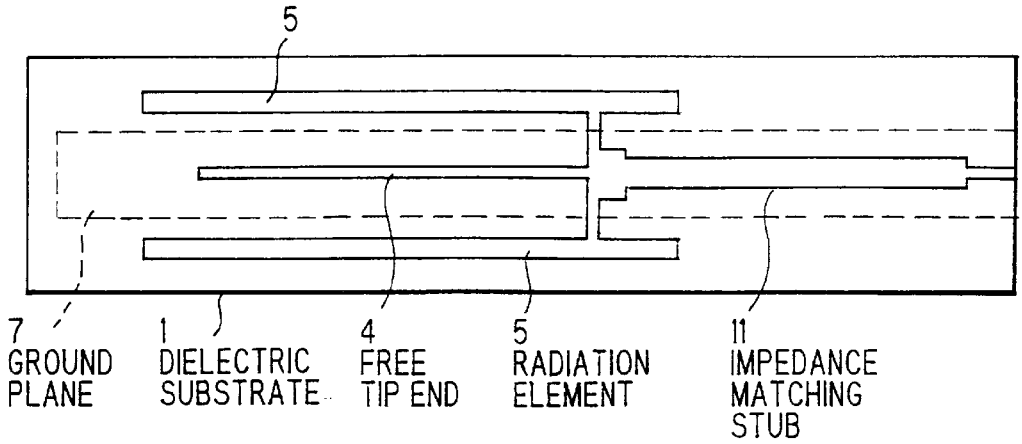
FIG. 17 is a plan view of an antenna according to a further preferred embodiment of the invention.

The antenna shown in FIG. 17 has the same construction as the antenna shown in FIG. 10, except that an impedance matching stub is provided. Specifically, an impedance matching stub 11 having an electrical length of one quarter wavelength is provided at a site which is nearer the base end than the site where the feeding line 3 intersects the micro-strip line 2. The provision of the stub can provide impedance matching, resulting in reduced mismatching. The operation and effect of the antenna shown in FIG. 17 are the same as those of the antenna shown in FIG. 10. In addition, the provision of the stub 11 can offer a high gain. Thus, the antenna of the present invention can be provided with a distributed element or one-quarter wavelength (electrical length) stub matching circuit or distribution circuit.

In any of the above preferred embodiments, the antenna is lightweight and thin and can be conveniently used. Further, the dimensional accuracy is so high that the quality is stable and the reliability is high. Further, the fabrication is simple, enabling the antenna to be produced at a low cost.

Figure 18:
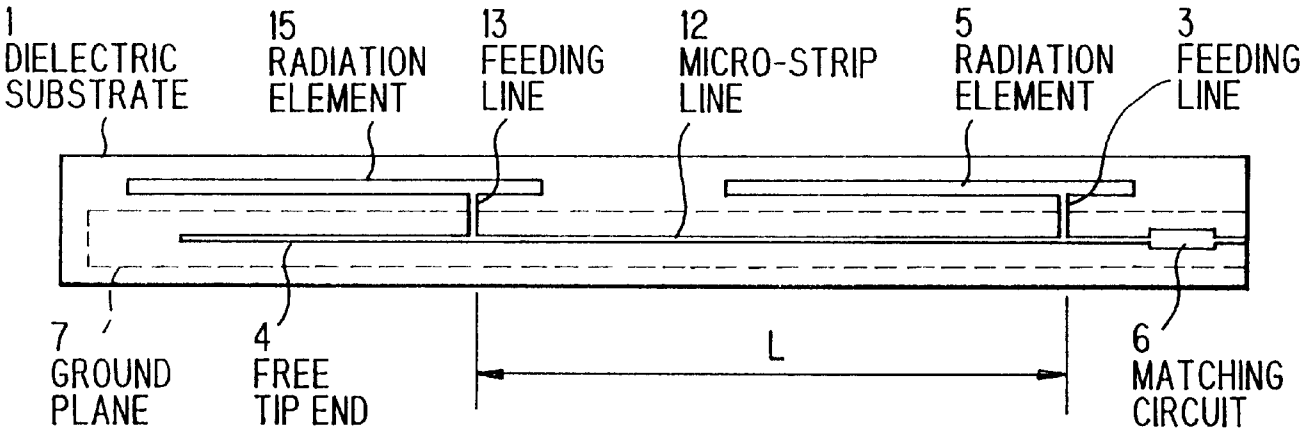
FIG. 18 is a plan view of an array antenna according to a preferred embodiment of the invention.

The antenna shown in FIG. 18 has the same construction as the antenna shown in FIGS. 5A and 5B, except that the antenna is coupled in two stages to construct a collinear antenna. Specifically, the substrate 1, the micro-strip line 2 and the ground conductor 7 are extended in the longitudinal direction, and a second-stage feeding line 13 is provided at a site which is partway the extended micro-strip line 12, and a second-stage radiation element 15 is connected to the feeding line 13. The distance L between the first-stage feeding point and the second-stage feeding point is one corresponding to an electrical length of not less than a half wavelength. Varying the distance L between the feeding points can vary the directivity, that is, can provide a tilt. This array antenna is lightweight and thin and can be conveniently used. Further, since the dimensional accuracy is so high that the quality is stable. In addition, the fabrication is simple, enabling the antenna to be produced at a low cost. Furthermore, a feeding line (a coaxial cable, a coplanar line or the like) for feeding to the upper antenna may be provided on the ground conductor side. Therefore, a multistage diversity antenna can be constructed.

Figure 19:
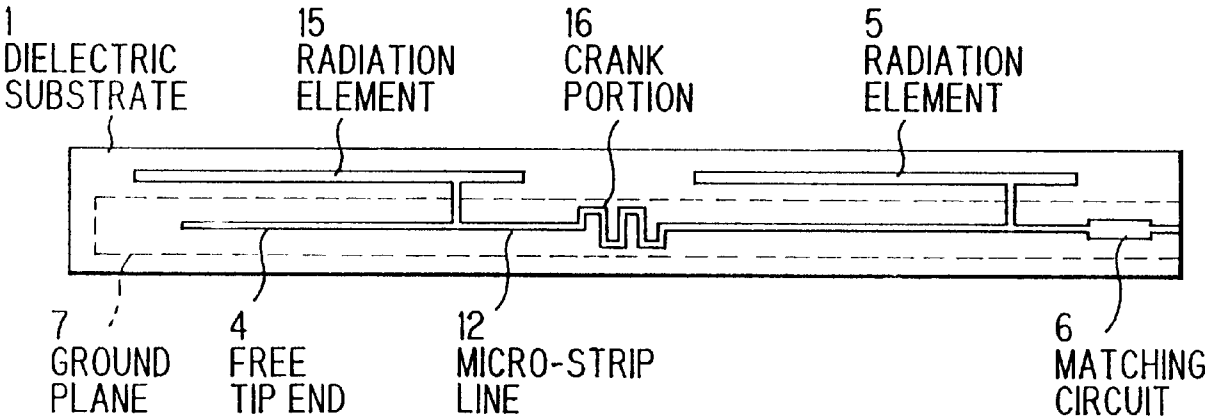
FIG. 19 is a plan view of an array antenna according to another preferred embodiment of the invention.

The array antenna shown in FIG. 19 has the same construction as the antenna shown in FIG. 18, except that a crank portion is inserted into the micro-strip line 12 between the antennas of the array antenna.

In the above preferred embodiments, the micro-strip line has been used. A coplanar line, a triplate line, a parallel flat sheet line and the like may be used instead of the micro-strip line.

As described above, the antenna of the present invention has a construction comprising a micro-strip line, a feeding line, and a radiation element, permitting a diversity antenna to be constructed.

Figure 20A:
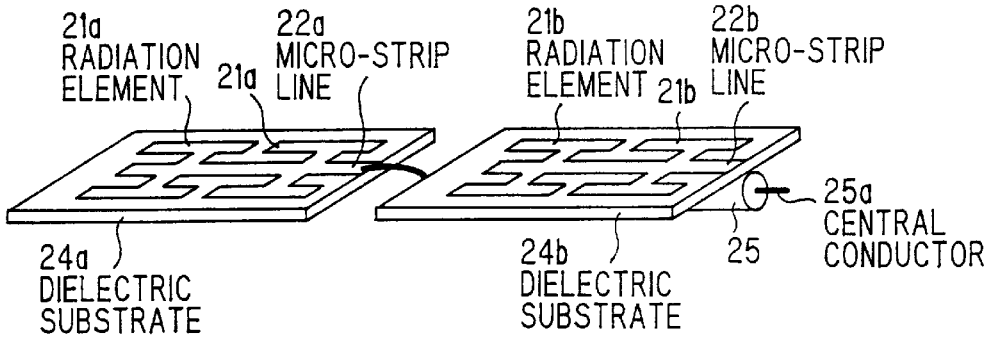
FIGS. 20A and 20B are perspective views of a diversity antenna according to a preferred embodiment of the invention.
Figure 20B:
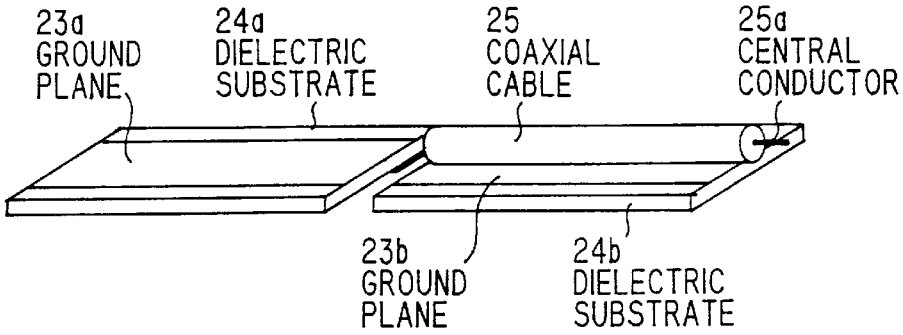

FIGS. 20A and 20B are diagrams showing the construction of a diversity antenna according to the present invention. FIG. 20A shows one side of the diversity antenna, and FIG. 20B show the other side (ground plane) of the diversity antenna. This diversity antenna are structured so that two flat antennas (upper and lower antennas) are vertically arranged (the antenna on the left side in the drawing being the upper antenna) so as to attain diversity effect. It can be applied to a base station and the like of PHS communication. The flat substrate constituting the support of the flat antennas is made of a dielectric or a semiconductor. The suffice letter a attached to the reference numeral of each element represents that the element constitutes the upper antenna, while the suffice letter b attached to the reference numeral of each element represents that the element constitutes the lower antenna.

As shown in the drawing, in each antenna, radiation elements 21*a*, 21*b* and micro-strip lines 22*a*, 22*b* including feeding lines for feeding to the radiation elements 21*a*, 22*b* are provided respectively on one side of the substrates 24*a*, 24*b*. The radiation elements 21*a*, 22*b* and the micro-strip lines 22*a*, 22*b* are constituted by a thin-film conductor. The radiation elements 21*a*, 22*b* are linearly provided so as to have a predetermined electrical length in the longitudinal direction. The micro-strip lines 22*a*, 22*b* are linearly provided parallel respectively to the radiation elements 21*a*, 22*b* . The feeding lines (reference numeral not indicated) for feeding to the radiation elements 21*a*, 22*b* are extended from the micro-strip lines 22*a*, 22*b* in a direction normal to the micro-strip lines 22*a*, 22*b*. Ground conductor films 23*a*, 23*b* are provided on the side of the substrates 24*a*, 24*b* opposite to the micro-strip lines 22*a*, 22*b*. The planes on which the ground conductor films 23*a*, 23*b* are provided are referred to as the "ground plane" of the antenna. These antennas are prepared by a microfabrication process and a printed board fabrication process. A coaxial feeding line 25 is provided, as a feeding line for feeding to the micro-strip line 22*a* of the upper antenna, along the ground plane on which the ground conductor film 23*b* for the lower antenna is provided.

The two antennas, upper and lower antennas, are vertically arranged so that the micro-strip lines 22*a*, 22*b* are overlapped with each other in the respective extended directions.

In this preferred embodiment, four radiation elements 21*a*, 22*b* are provided for each antenna.

The ground planes for the respective antennas face an identical direction, and the planes on which the radiation elements 21*a*, 22*b* and the micro-strip lines 22*a*, 22*b* are provided face an identical direction which is opposite to the direction in which the ground planes face.

The coaxial feeding line 25 comprises an outer conductor having a cylindrical appearance and an internal conductor passing through the axial center portion of the outer conductor. This internal conductor is extended from the ground plane side of the lower antenna, passes through between the edge of the upper antenna substrate 24*a* and the edge of the lower antenna substrate 24*b*, and is connected to the end of the micro-strip line 22*a* of the upper antenna.

the operation of the diversity antenna shown in FIGS. 20A and 20B will be explained.

A feeding signal from the feeding line (not shown) to the lower antenna is fed to the radiation element 22*b* through the micro-strip line 22*b*. This permits a radio wave to be radiated from the radiation element 22*b*. A feeding signal to be fed to the upper antenna is fed from the coaxial feeding line 25 provided along the ground plane of the lower antenna to the radiation element 22*a* through the micro-strip line 22*a*. This permits a radio wave to be radiated from the radiation element 21*a*.

In this case, since the coaxial feeding line 25 is provided along the ground plane of the lower antenna, a ground conductor film 23*b* exists between the coaxial feeding line 25 and the radiation element 22*b* and the micro-strip line 22*b* of the lower antenna. Therefore, the coaxial feeding line 25 does not influence the radiation characteristics and the impedance characteristics of the lower antenna, and both the upper antenna and the lower antenna can realize good radiation characteristics and impedance characteristics.

In this diversity antenna, each antenna comprises a thin-film conductor provided on a dielectric or semiconductor substrate. Therefore, the antenna can be prepared by a microfabrication process and a printed board process, offering advantages such as excellent fabrication accuracy, excellent mass productivity, reduced thickness, reduced weight, and simple handling.

Further preferred embodiments will be then explained.

Figure 21:
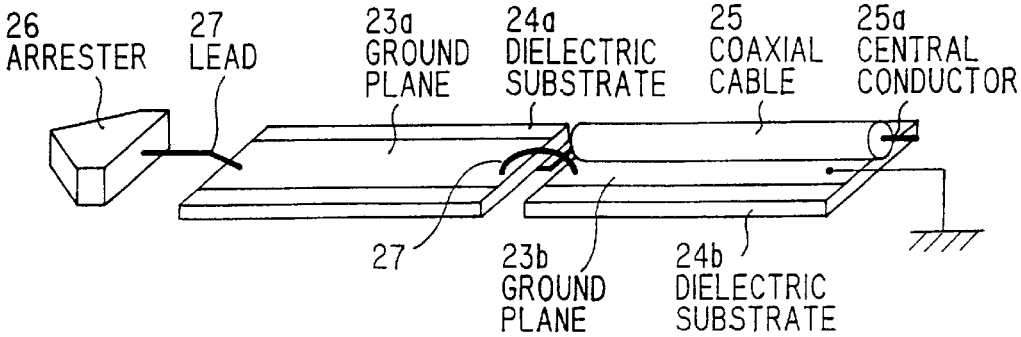
FIG. 21 is a diagram showing the construction of a diversity antenna according to another preferred embodiment of the invention.

FIG. 21 is a diagram showing the construction of an arrester type diversity antenna (a diagram showing the ground plane). This arrester type diversity antenna has the same construction as the diversity antenna shown in FIGS. 20A and 20B, except that a metal top 26 constituting an arrester is provided on one end side of an array of antennas in the diversity antenna shown in FIGS. 20A and 20B, that is, on the apex of the upper antenna. The metal top 26 is connected to the ground conductor film 23*a* of the upper antenna through the arrester conductor line 27. In this construction, the ground conductor films 23*a*, 23*b* serve also as the arrester conductor.

Figure 22A:
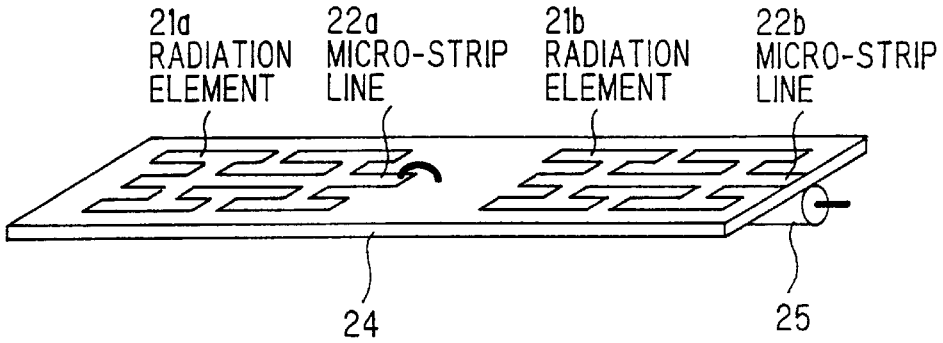
FIGS. 22A and 22B are diagrams showing the construction of a diversity antenna according to still another preferred embodiment of the invention.
Figure 22B:
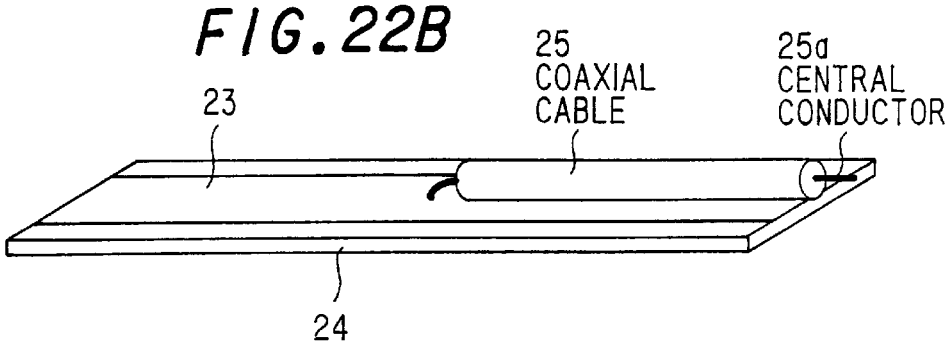

FIGS. 22A and 22B are diagrams showing the construction of an integral diversity antenna. FIG. 22A shows one side of the antenna, and FIG. 22B shows the other side (ground plane) of the antenna. This integral diversity antenna has the same construction as the diversity antenna shown in FIGS. 20A and 20B, except that, in the diversity antenna shown in FIGS. 20A and 20B, two antennas are separately provided, whereas in the diversity antenna shown in FIGS. 22A and 22B, the two antennas are arranged on an integral substrate. Specifically, radiation elements 21*a*, 22*b* and micro-strip lines 22*a*, 22*b* including feeding lines for feeding to the radiation elements 21*a*, 22*b*, constituting the upper and lower antennas, are arranged on one side of substrate 24. A ground conductor film 23 is continuously provided in the upper and lower antennas on the side of the substrate 24 opposite to the micro-strip lines.

A coaxial feeding line 25 is provided, as a feeding line for feeding to the micro-strip line 22*a* of the upper antenna, along the lower antenna in its ground plane having the ground conductor film 23. A hole (not shown) for leading an internal conductor extended from the coaxial feeding line 25 on the ground plane side to the micro-strip line 22*a* of the upper antenna is provided between the upper antenna and the lower antenna on the substrate 24. The internal conductor is extended through the hole and connected to the end of the micro-strip line 22*a* of the upper antenna.

This integral diversity antenna can realize good radiation characteristics and impedance characteristics equivalent to those of the diversity antenna shown in FIGS. 20A and 20B. Further, since the upper and lower antennas are provided on an integral substrate, there is no need to vertically arrange two separate antennas, to arrange the direction of the plane, and to regulate the spatial distance. Further, the fixation of the substrate can be simplified, and troublesome connection between ground conductor films can be eliminated.

Figure 23:
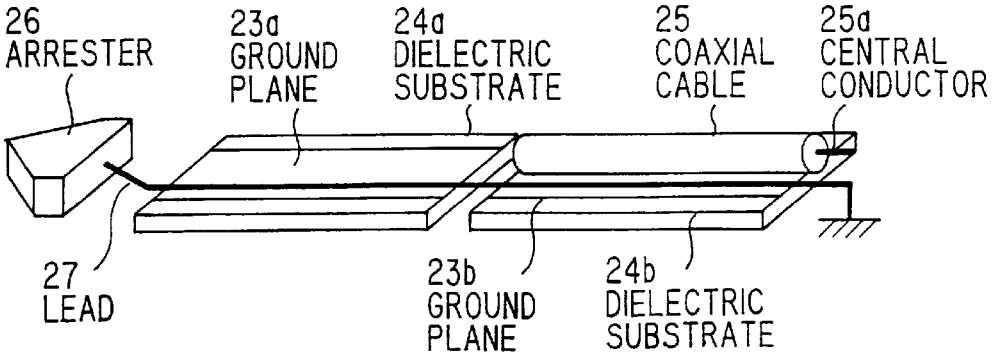
FIG. 23 is a diagram showing the construction of a diversity antenna according to a further preferred embodiment of the invention.

FIG. 23 is a diagram showing the construction of an arrester type diversity antenna (a diagram illustrating the ground plane). In this arrester type diversity antenna, unlike the diversity antenna shown in FIG. 21, the ground conductor films 23*a*, 23*b* do not serve also as the arrester conductor. An arrester conductor line 27 connected to a metal top 26 is extended along the ground planes of the upper and lower antennas to the base of the antenna and then grounded.

As explained above, the diversity antenna of the present invention has the following excellent effects.

(1) Provision of the coaxial feeding line along the ground plane can realize a diversity antenna having good radiation characteristics and impedance characteristics.

(2) Each antenna comprises a thin-film conductor provided on a dielectric or semiconductor substrate. This enables the production of a diversity antenna that is lightweight, easy to handle, can be produced with improved fabrication accuracy, and can be produced at a low cost with stable quality.

The invention has been described in detail with particular reference to preferred embodiments, but it will be understood that variations and modifications can be effected within the scope of the present invention as set forth in the appended claims.

What is claimed is:

1. An antenna comprising: a dielectric or semiconductor substrate; and, provided on the substrate, a conductive micro-strip line, a feeding, line in contact with the micro-strip line, and a radiation element connected to the feeding line, a ground conductor being provided on the side of the substrate opposite to the micro-strip line, wherein the radiation element is disposed on the side of the substrate opposite to the micro-strip line in such a manner that the radiation element is connected to the feeding line through a through-hole or a wire.

2. The antenna according to claim 1, wherein a non-feeding element is provided along the radiation element.

3. The antenna according to claim 2, wherein the radiation element is provided on both sides of the micro-strip line.

4. The antenna according to claim 2, wherein the radiation element, the micro-strip line, or the non-feeding element is short-circuited by the ground conductor at one point.

5. The antenna according to claim 2, wherein a plurality of the antennas are successively arranged in the longitudinal direction to form an array antenna.

6. The antenna according to claim 1, wherein a non-feeding element is provided along the radiation element.

7. The antenna according to claim 1, wherein the radiation element is provided on both sides of the micro-strip line.

8. The antenna according to claim 7, wherein the radiation element, the micro-strip line, or the non-feeding element is short-circuited by the ground conductor at one point.

9. The antenna according to claim 7, wherein a plurality of the antennas are successively arranged in the longitudinal direction to form an array antenna.

10. The antenna according to claim 1, wherein the radiation element is provided on both sides of the micro-strip line.

11. The antenna according to claim 1, wherein the radiation element, a micro-strip line, or the non-feeding element is short-circuited by the ground conductor at one point.

12. The antenna according to claim 1, wherein the radiation element, the micro-strip line, or the non-feeding element is short-circuited by the ground conductor at one point.

13. The antenna according to claim 1, wherein a plurality of the antennas are successively arranged in the longitudinal direction to form an array antenna.

14. The antenna according to claim 13, wherein the antennas are arranged at varied spacing in terms of the spacing between adjacent antennas.

15. The antenna according to claim 1, wherein a plurality of the antennas are successively arranged in the longitudinal direction to form an array antenna.

16. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided.

17. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided;

wherein the plurality of the antennas are provided so that the ground planes of the respective antennas face the same direction.

18. The diversity antenna according to claim 17, wherein an internal conductor extended from the coaxial feeding line is connected to the micro-strip line in said one of the antennas.

19. The diversity antenna according to claim 17, wherein the plurality of antennas are arranged on an integral substrate.

20. The diversity antenna according to claim 17, wherein a hole for leading an internal conductor, extended from the coaxial feeding line on the ground plane side of said another antenna, to the micro-strip line of said one of the antennas is provided in the substrate.

21. The diversity antenna according to claim 17, wherein a metal top constituting an arrester is provided on one end side of the plurality of the antennas.

22. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided:

wherein the plurality of the antennas are vertically arranged; and wherein the plurality of the antennas are provided so that the ground planes of the respective antennas face the same direction.

23. The diversity antenna according to claim 22, wherein a hole for leading an internal conductor, extended from the coaxial feeding line on the ground plane side of said another antenna, to the micro-strip line of said one of the antennas is provided in the substrate.

24. The diversity antenna according to claim 22, wherein the plurality of antennas are arranged on an integral substrate.

25. The diversity antenna according to claim 22, wherein an internal conductor extended from the coaxial feeding line is connected to the micro-strip line in said one of the antennas.

26. The diversity antenna according to claim 22, wherein a plurality off radiation elements are provided in each of the plurality of the antennas.

27. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided;

wherein a plurality of radiation elements are provided in each of the plurality of antennas; and wherein the plurality of the antennas are provided so that the ground planes of the respective antennas face the same direction.

28. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided;

wherein an internal conductor extended from the coaxial feeding line is connected to the micro-strip line in said one of the antennas; and wherein a metal top constituting an arrester is provided on one end side of the plurality of the antennas.

29. The diversity antenna according to claim 28, wherein the plurality of antennas are arranged on an integral substrate.

30. The diversity antenna according to claim 28, wherein a hole for leading an internal conductor, extended from the coaxial feeding line on the ground plane side of said another antenna, to the micro-strip line of said one of the antennas is provided in the substrate.

31. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided;

wherein the plurality of antennas are arranged on an integral substrate; and wherein a metal top constituting an arrester is provided on one end side of the plurality of the antennas.

32. The diversity antenna according to claim 31, wherein a hole for leading an internal conductor, extended from the coaxial feeding line on the ground plane side of said another antenna, to the micro-strip line of said one of the antennas is provided in the substrate.

33. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided; and wherein a metal top constituting an arrester is provided on one end side of the plurality of the antennas.

34. The diversity antenna according to claim 33, wherein the metal top is connected to the ground conductor film so that the ground conductor film serves also as an arrester conductor.

35. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided;

wherein the plurality of the antennas are vertically arranged; and wherein a metal top constituting an arrester is provided on one end side of the plurality of the antennas.

36. The diversity antenna according to claim 35, wherein a plurality of radiation elements are provided in each of the plurality of the antennas.

37. The diversity antenna according to claim 35, wherein an internal conductor extended from the coaxial feeding line is connected to the micro-strip line in said one of the antennas.

38. The diversity antenna according to claim 35, wherein the plurality of antennas are arranged on an integral substrate.

39. The diversity antenna according to claim 35, wherein a hole for leading an internal conductor, extended from the coaxial feeding line on the ground plane side of said another antenna, to the micro-strip line of said one of the antennas is provided in the substrate.

40. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided;

wherein a plurality of radiation elements are provided in each of the plurality of antennas; and wherein a metal top constituting an arrester is provided on one end side of the plurality of the antennas.

41. The diversity antenna according to claim 40, wherein an internal conductor extended from the coaxial feeding line is connected to the micro-strip line in said one of the antennas.

42. The diversity antenna according to claim 40, wherein the plurality of antennas are arranged on an integral substrate.

43. The diversity antenna according to claim 40, wherein a hole for leading an internal conductor, extended from the coaxial feeding line on the ground plane side of said another antenna, to the micro-strip line of said one of the antennas is provided in the substrate.

44. The diversity antenna according to claim 40, wherein an internal conductor extended from the coaxial feeding line is connected to the micro-strip line in said one of the antennas.

45. The diversity antenna according to claim 40, wherein the plurality of antennas are arranged on an integral substrate.

46. A diversity antenna comprising a plurality of arranged antennas, each of the antennas comprising a dielectric or semiconductor substrate, a conductive film, provided on one side of the substrate, for constituting a radiation element and a micro-strip line including a feeding line leading to the radiation element, and a ground conductor film provided on the other side of the substrate, a coaxial feeding line leading to one of the antennas being provided along a ground plane, of another antenna, on which the ground conductor film is provided;

wherein a hole for leading an internal conductor, extended from the coaxial feeding line on the ground plane side of said another antenna, to the micro-strip line of said one of the antennas is provided in the substrate; and wherein a metal top constituting an arrester is provided on one end side of the plurality of the antennas.

* * * * *